United States Patent [19]

Takenaka et al.

[11] 4,368,405

[45] Jan. 11, 1983

[54] ELECTRON GUN FOR A CATHODE RAY TUBE

[75] Inventors: Shigeo Takenaka, Fukaya; Eizaburo Hamano, Kumagaya; Shinpei Koshigoe, Fukaya, all of Japan

[73] Assignee: Tokyo Shibaura Denki Kabushiki Kaisha, Kawasaki, Japan

[21] Appl. No.: 191,016

[22] Filed: Sep. 26, 1980

Related U.S. Application Data

[63] Continuation of Ser. No. 961,855, Nov. 17, 1978, abandoned.

[30] Foreign Application Priority Data

Nov. 22, 1977 [JP] Japan ..... 52-139480
Dec. 27, 1977 [JP] Japan ..... 52-156501

[51] Int. Cl.[3] ..... H01J 29/46; H01J 29/56
[52] U.S. Cl. ..... 315/16; 313/449
[58] Field of Search ..... 315/16, 31 TV, 382; 313/449

[56] References Cited

U.S. PATENT DOCUMENTS 3,895,253 7/1975 Schwartz et al. ..... 313/449
3,995,194 11/1976 Blacker et al. ..... 315/16
4,124,810 11/1978 Bortfeld et al. ..... 313/449 X

FOREIGN PATENT DOCUMENTS 29-2216 4/1954 Japan .

*Primary Examiner*—Theodore M. Blum
*Attorney, Agent, or Firm*—Cushman, Darby & Cushman

[57] ABSTRACT

A cathode ray tube electron gun having an electron beam-generating source and a main lens system for focusing electron beams emitted from said electron beam-generating source, wherein the main lens system comprises at least first, second, third and fourth focusing electrodes arranged coaxially and in the order mentioned an counted from said electron beam-generating source; the first and third focusing electrodes are impressed with substantially the same potential; and the fourth focusing electrode is supplied with a prescribed potential higher than those which are applied to said first and third focusing electrodes.

8 Claims, 12 Drawing Figures

ELECTRON GUN FOR A CATHODE RAY TUBE

This is a continuation of application Ser. No. 961,855 filed Nov. 17, 1978, now abandoned.

BACKGROUND OF THE INVENTION

The invention relates to an electron gun for an cathode ray tube, which uses a main lens system designed to focus electron beams emitted from an electron beam generating source.

As is well known, an electron gun for a cathode ray tube (not shown) generally comprises two fundamental sections, that is, a source of electron beams and lens system for focusing electron beams on the fluorescent screen of the cathode ray tube. Customarily, the former is referred to as "a triode-electrode section", and the latter as "a focusing lens (main lens) system". The focusing lens (main lens) system of electron guns for cathode ray tubes used with presently marketed color television receiving sets is mostly of the electro-static focusing type, comprising coaxially arranged conductive tubular elements (electrodes), having predetermined voltages thereacross to produce a desired electric field for focusing electron beams.

Electron guns are generally classified into three types: bipotential types, unipotential types and tripotential types (the latter disclosed in the U.S. Pat. No. 3,995,194).

There will now be described by reference to FIG. 1 the arrangement of electrodes constituting the focusing lens system of the above-mentioned three types of electron guns and the axial distributions of potentials thereof. The bipotential type of electron gun (FIG. 1*a*) comprises a main lens system formed of two focusing electrodes 1 and 2. The electrode 1 disposed adjacent to the cathode has a relatively low potential. The electrode 2 positioned near the fluorescent screen of the cathode ray tube has a relatively high potential. A potential across these two electrodes consititutiing the main lens system has a monotonic or substantially uniformly increasing distribution pattern as illustrated by a curve 3. The axial potential distribution of the electrodes constituting the main lens system of the bipotential type electron gun is referred to as "monotonic", because the first derivative is expressed without changing its sign. However, some of the bipotential type main lens systems of the above-mentioned arrangement have an unsatisfactory spherical aberration characteristic. In a considerably small space like the neck portion of a cathode ray tube provided with the above-mentioned bipotential type electron gun, it is impossible in the case of a particularly high current electron beam to sufficiently reduce the size of a focused electron beam spot, and as a result resolution is not improved.

FIG. 1(*b*) illustrates the axial potential of a unipotential type main lens system consisting of three focusing electrodes 4, 5 and 6. The axial potential distribution indicates a substantially saddle-shaped pattern as illustrated by a curve 7, with the potentials at the forward and backward ends of the main lens system set at substantially the same level. The unipotential type main lens system arranged as described above indeed, enables a focused electron beam spot to be reduced, but has the drawback that breakdown arises in the cathode ray tube provided with an electron gun comprising said unipotential type main lens system because of a larger potential difference between electrode 4 and the triode-electrode section.

The tripotential type main lens system of FIG. 1(*c*) is formed of at least three, or preferably four focusing electrodes 8, 9, 10 and 11. The axial potential distribution has a pattern illustrated by a curve 12, which indicates a potential monotonically shifting from a relatively intermediate level to a relatively low level and then monotonically and continuously shifting to a high level.

Unlike the electron guns provided with the bi-potential type main lens system, the electron gun comprising the tripotential type main lens system enables the focused electron beam spot to be satisfactorily reduced. However, the tripotential type electron gun has the drawbacks that a further power source has to be provided to apply a intermediate potential for the focusing electrodes, the length of an electron gun is longer, and it is necessary to assemble a triode-electrode section with extremely high precision.

The second derivative of each of the axial potential distributions of the aforesaid three types of main lens system is denoted by a curve having a positive maximum value as indicated by a curve 3' of a coordinate system given below FIG. 1(*a*) for the bipotential type; by a curve 7' of a coordinate system shown below FIG. 1(*b*) for the unipotential type; and by a curve 12' of a coordinate system set forth below FIG. 1(*c*) for the tripotential type. Therefore, these main lens systems are each referred to as "a single lens".

The performance of an electron gun is primarily expressed by the diameter of an electron beam focused on the fluorescent screen of the cathode ray tube. As generally accepted the smaller said diameter, the more improved the performance of the main lens system, and in consequence the higher the focusing efficiency. In this connection the following description may be given from the standpoint of electron optics. The diameter $D_T$ of an electron beam focused by the focusing lens of an electron gun is shown as follows:

$$D_T = \sqrt{(D_X + D_{SA})^2 + D_{SC}^2}$$

$$D_X = M \cdot d_X$$

$$D_{SA} = \tfrac{1}{2} \cdot M \cdot C_S \cdot \alpha_O^3$$

Where:

M: magnification $D_X$: diameter of an electron beam depending on the magnification $D_{SA}$: expansion of the diameter of an electron beam resulting from a spherical aberration $D_{SC}$: expansion of the diameter of an electron beam caused by the mutual repulsion of electrons $d_X$: diameter of an electron beam at imaginary object $C_S$: spherical aberration coefficient $\alpha_O$: divergent angle of an electron beam Accordingly, it is preferred for the main (focusing) lens system of an electron gun that the electron optical magnification (M), the size $d_x$ of imaginary object as observed from the main lens system of an electron gun, the spherical aberration coefficient $C_S$ and the divergent angle $\alpha_O$ of an electron beam as observed from the main lens system of an electron gun are made as small as possible.

A distance between the geometric center of the main lens of an electron gun and a fluorescent screen (an approximate focal length) is determined in relation to the diameter $D_X$ of an electron beam depending on the electron optical magnification degree M, the expansion $D_{SA}$ of the diameter of an electron beam resulting from a spherical aberration and the expansion $D_{SC}$ of the diameter of an electron beam caused by the mutual repulsion of electrons. If the distance is fixed the best condition of reducing the diameter of an electron beam as much as possible can be arrived at as illustrated in FIGS. 2(*a*) and 2(*b*) for the uni- and bi-potential types of the main lens system of an electron gun respectively. Unless, in this case, the 3-electrode section is properly assembled with the main lens system of an electron gun. The balance due to the resolution of the central portion of a screen, the uniformity of light quantity throughout the central and peripheral portions of the screen, and blooming prominently appeared when very high current will decrease.

Therefore, the electron beam-generating electrode, first and second grid electrodes constituting the triode-electrode section, which define the scattering angle of an electron beam and the position of the spot of an imaginary object, should be spaced from each other with great care. And, the design of the triode-electrode section and that of the main lens system should be examined collectively. The reason is that particularly the prefocus characteristic of an electron gun is determined by the level of voltage applied on those of the electrodes positioned nearest to the cathode side of the main lens system (the electrodes denoted by referential numerals 1, 4 and 8 in FIG. 1) and the inter-electrode distance between the main lens system and the triode-electrode section.

A color television receiving set generally comprises three electron guns. In an electron gun having a bipotential type main lens system, generally the cathode is applied with voltage of about 100 to 150 V; the first grid electrode is supplied with grounding voltage; the second grid electrode with voltage of about 400 to 800 V; the third electrode (first focusing electrode) with voltage of several kilovolts as 4.4 to 5.0 KV; and the fourth electrode (second focusing electrode) having the same potential as the fluorescent screen with voltage of 20 to 30 KV.

The third electrode (first focusing electrode) is about 3.5 times longer than the diameter of the main lens system. An electron beam has a relatively large divergent angle of about 4° to 5.5° as observed from the main lens system. And the third electrode (first focusing electrode) is applied with voltage of several kilovolts as 4.4 to 5.0 KV at most. Therefore, the so-called cross-over position appearing at the triode-electrode section varies with a video signal supplied to the first grid electrode or cathode, and tends to give rise to blooming when a particularly high current is introduced. As compared with electron optical magnification of an electron gun comprising a unipotential type main lens system, the magnification of an electron gun having a bipotential type main lens system is smaller, so that degree of resolution with respect to the so-called low brightness when a low current is introduced is higher. However, the bipotential type electron gun has the drawbacks that an electron beam has a large divergent angle, resulting in a decline in the uniformity of focusing and a prominent appearance of blooming.

In contrast, in an electron gun having an unipotential type main lens system the third electrode (first focusing electrode) and fifth electrode (third focusing electrode) are applied with high voltage (or the same voltage as that applied to a fluorescent screen), and the fourth electrode (second focusing electrode) is supplied with a substantially zero volt or several kilovolts. Consequently, as the divergent angle of an electron beam is as small as about 2°, a more satisfactory uniformity of light quantity is attained throughout the central and peripheral portions of a screen, and the appearance of blooming is suppressed more effectively. However, the electron optical magnification is slightly larger than in a bipotential type main lens system, thereby the resolution is somewhat lower at the time of low brightness when a low current is introduced.

The tripotential type focusing lens system is disclosed in the U.S. Pat. No. 3,995,194. Where a difference between the maximum and minimum values of the second derivative $V_o''$ of the distribution of the potential $V_o$ is reduced as much as possible in the region where the potential distribution in the axial direction of the focusing lens system has a small value or in the region where electron beam collectively has a large diameter, then it is possible to obtain a required focusing force, thereby restricting spherical aberration. The tripotential type focusing lens system comprises a third electrode (first focusing electrode) of FIG. 1(*c*) (8), a fourth electrode (second focusing electrode) of FIG. 1(*c*) (9), a fifth electrode (third focusing electrode) of FIG. 1(*c*) (10), and a sixth electrode (fourth focusing electrode) of FIG. 1(*c*) (11). The third (first focusing electrode) and the fifth electrode (third focusing electrode are applied with a relatively intermediate voltage of 10 to 12 KV; the fourth electrode (second focusing electrode) with a relatively low voltage of 5 to 7 KV; and the sixth electrode (fourth focusing electrode) with the potential of a fluorescent screen of 20 to 30 KV. The axial potential distribution of the tripotential type focusing lens system shows a pattern smoothly and monotonically shifting from a relatively intermediate potential level to a relatively low-potential level, further smoothly and monotonically shifting to high potential level.

With the tripotential type focusing lens system, the constituent focusing electrodes should have such arrangement and the voltage applied thereon should have such level that the aforesaid axial potential distribution acts as one focusing lens.

To this end, the lengths of the respective focusing electrodes normalized by the diameter of the main lens system are determined to be 0.5 to 2.2 for the fourth electrodes (second focusing electrode) of FIG. 1(*c*) (9) and 0.75 or less for the fifth electrode (third focusing electrode) of FIG. 1(*c*) (10). On the other hand, the length of the third electrode (first focusing electrode) of FIG. 1(*c*) (8) is determined primarily by the geometric dimensions of a color cathode ray tube and a value of voltage applied thereto. An electron gun comprising a tripotential main lens system is characterized in that the focusing electrodes having the main lens system are supplied with the two higher voltages (6 or 7 KV and 10 to 12 KV) than these applied to the customary electron gun having of a bipotential type main lens system to increase the degree of the electron optical magnification; a necessarily occurring rise in the spherical aberration is positively suppressed by converting said lens system into the aforesaid integral form. Consequently the resolution of a low brightness region is prominently improved (because a spherical aberration in a region of relatively low current is negligibly small); and since the third electrode (first focusing electrode) of FIG. 1*c* (8) is impressed with a relatively high level of voltage (10~12 KV), blooming is noticeably eliminated.

On the other hand, the focusing electrodes of the main lens system are elongated and, though the third electrode (first focusing electrode) of FIG. 1(*c*) (8) is impressed with a relatively high level of voltage, it fails appreciably to reduce the divergent angle of an electron beam as observed from the main lens system owing to the elongated focusing electrodes of the main lens system.

The electron gun formed of the tripotential main lens system has further disadvantages that where said electron gun is used with a self-concentration type color cathode ray tube which has recently become the leading type on the market, though the focus is very satisfactory in the central portion of a picture, the electron beam is subject to a deflection aberration caused by a very astigmatic magnetic field, so that the uniformity of the focus decreases; and the spherical aberration is affected by the deflection aberration to give rise to a spot distortion, leading to a further decrease in the uniformity of the focus.

Recent developments in color cathode ray tubes have improved the focusing characteristic of an electron gun. This improvement implies the formation of a smallest possible electron beam spot on a fluorescent screen. With the prior art main lens system, this requirement has to be met by the extremely high precision with which electron guns are assembled.

As is well known, the neck portion of a color cathode ray tube is provided with a color purity correction magnet and a convergence correction magnet in order to compensate for various errors in assembling the color cathode ray tube including an electron gun.

Where an attempt is made to improve the performance of an electron gun, the expansion $D_{SA}$ of the diameter of an electron beam depending on the spherical aberration becomes noticeable. Where, in such case, the assembling error of a cathode ray tube is corrected by the aforesaid magnets, so-called smudges tend to appear even in the central portion of a screen owing to the spherical aberration and spot distortion and the focusing characteristic of an electron gun decreases. Therefore, electron guns should be assembled with as high precision as possible.

The spherical aberration and spot distortion depend on the divergent angle of an electron beam emitted from its source, and consequently the unipotential type main lens system does not raise substantially great problems, but the bi- and tri-potential type main lens systems present considerable difficulties.

SUMMARY OF THE INVENTION

The object of the present invention is to provide an electron gun having a novel type of main lens system for a cathode ray tube more particularly for a cathode ray tube of which a magnetic field produced by a deflected yoke has a very high uniformity of distribution.

DESCRIPTION OF THE PREFERRED EMBODIMENTS

Figures 1, 3:
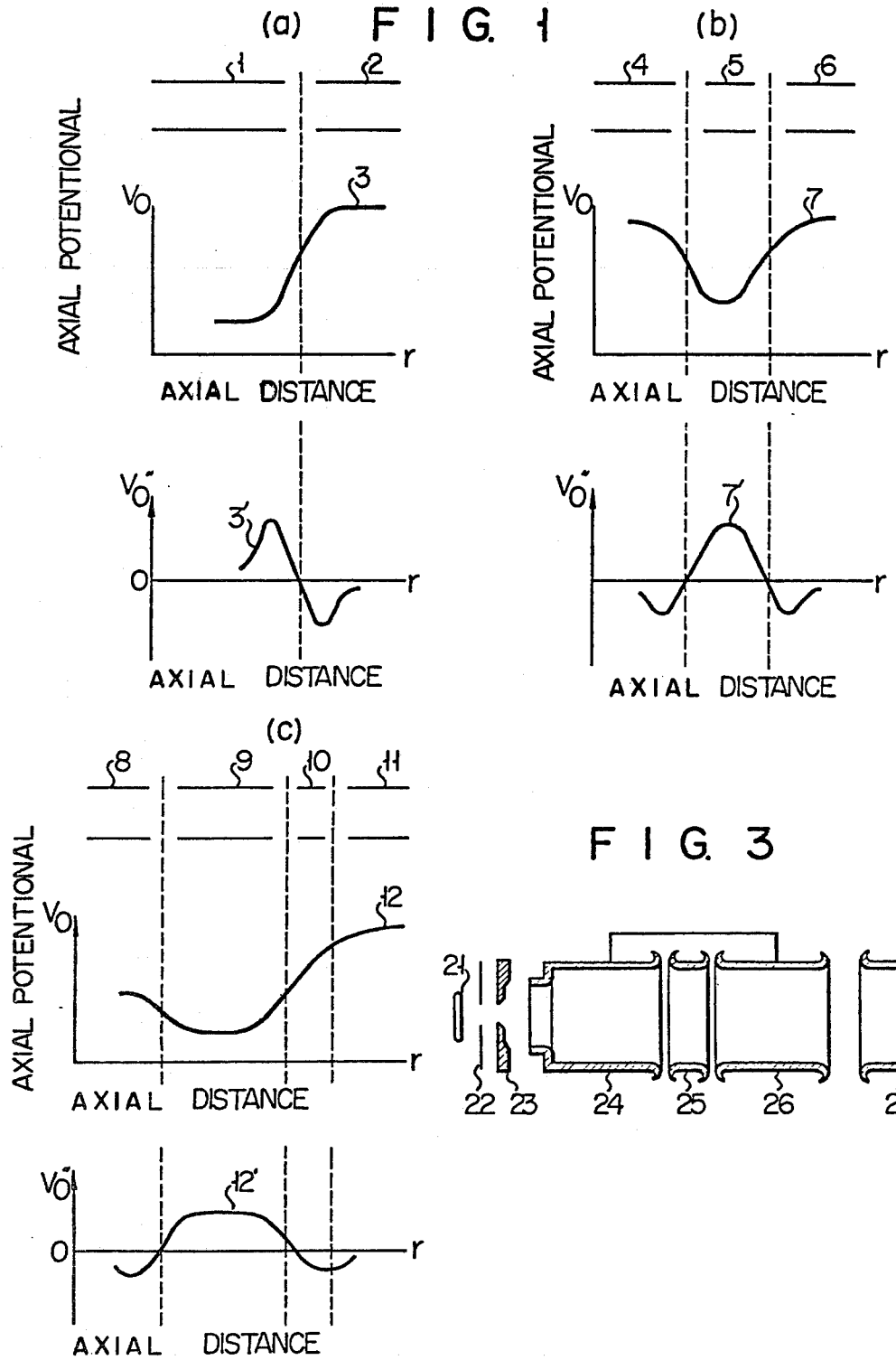
FIGS. 1(*a*), 1(*b*), and 1(*c*) graphically show the schematic arrangements of the prior art bi-, uni- and tri-potential type main lens systems of an electron gun, the functions of the axial potential distributions thereof, and the second derivatives of said potential distribution functions.
FIG. 3 is a sectional view of a main lens system according to one embodiment of the present invention which is used with a cathode ray tube electron gun.
Figure 2:
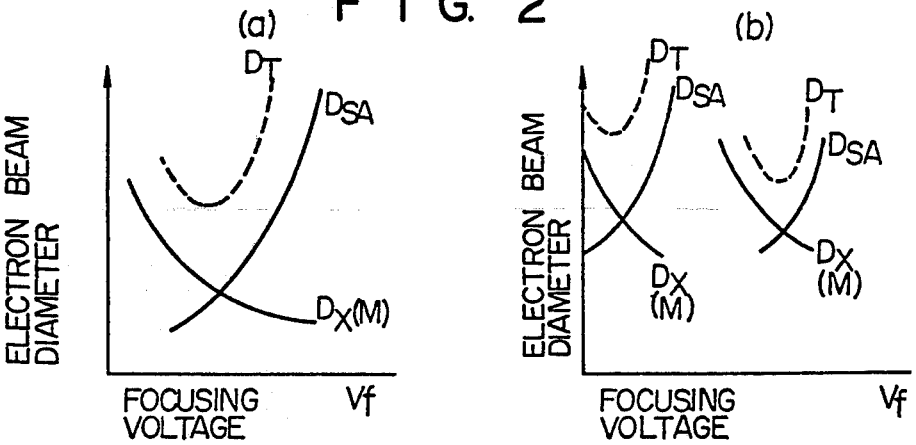
FIGS. 2(*a*) and 2(*b*) are graphs used to calculate the diameter of electron beams emitted from electron guns comprising the bi- and uni-potential type main lens systems.

Referring to FIG. 3, the electron gun comprises a triode-electrode section (electron beam-generating source) including a cathode 21 or electron beam-emitting electrode, first grid electrode 22 and second grid electrode 23; and a main lens system formed of a first focusing electrode 24, second focusing electrode 25, third focusing electrode 26 and fourth focusing electrode 27, all of cylindrical form. A D.C. voltage of 100 to 150 V and a video signal are generally applied to cathode 21. The first grid electrode 22 is substantially supplied with a grounding potential, and the second grid electrode 23 with a potential of about 400 to 1000 V. The first focusing electrode 24 and third focusing electrode 26 are supplied with the same voltage from the inside or outside of the cathode ray tube to have substantially the same potential, that is, a potential of 4.4 to 10 KV, thus constituting the so-called focusing electrodes. The second focusing electrode 25 has a lower potential than the first and third focusing electrodes 24, 26. The fourth focusing electrode 27 is impressed with substantially the same high voltage of 20 to 30 KV as applied to a fluorescent screen. In the above-mentioned electrode arrangement, the length of the second focusing electrode 25 is 0.2 to 0.5 times long as the diameter of the main lens system, and is made much shorter than the first and third focusing electrodes 24, 26.

Figure 4:
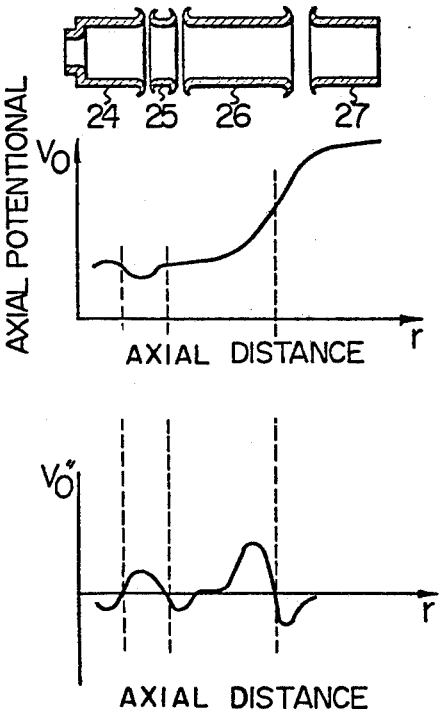
FIG. 4 illustrates the arrangement of the same type of main lens system as that of FIG. 3 and graphically indicates the function of the axial potential distribution and the second derivative of said function.

The axial potential distribution of a main lens system of an electron gun embodying this invention for a color cathode ray tube has a pattern which shifts, as illustrated by the curve of FIG. 4, gently and monotonically from a relatively intermediate level to a relatively low level, and further monotonously shifts to a relatively high potential level. The second derivative of said function has two positive maximum values and three negative maximum values.

Figure 5:
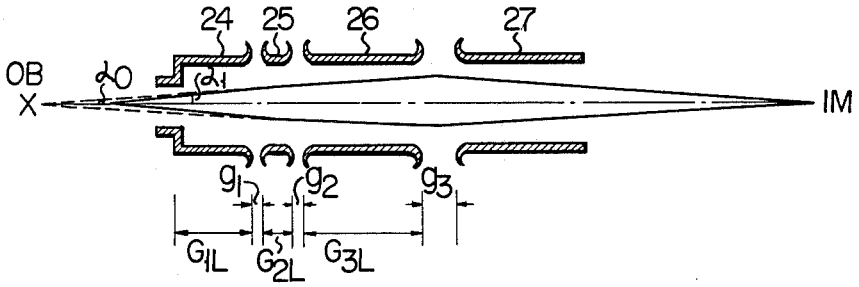
FIG. 5 sets forth the flow of an electron beam through the main lens system of FIG. 3.

The arrangement of the main lens system embodying the present invention is characterized in that an auxiliary lens, made much thinner than the other focusing electrodes and impressed with much lower voltage that is for example the same voltage as applied to the second electrode, is inserted between the two purposely divided portions of the first focusing electrode of said prior art bipotential type main lens system. Consequently, the scattering angle of an electron beam as observed from the main lens system of an electron gun is reduced to such slight extent that as shown in FIG. 5, the divergent angle $\alpha_1$ indicates 4° to 5° and the divergent angle $\alpha_0$ shows 3°to 4°. Wherein $\alpha_1$ and $\alpha_0$ are angle inview from first, second and third focusing electrodes 24, 25, 26, third and fourth electrodes 26, 27 respectively.

Figure 6:
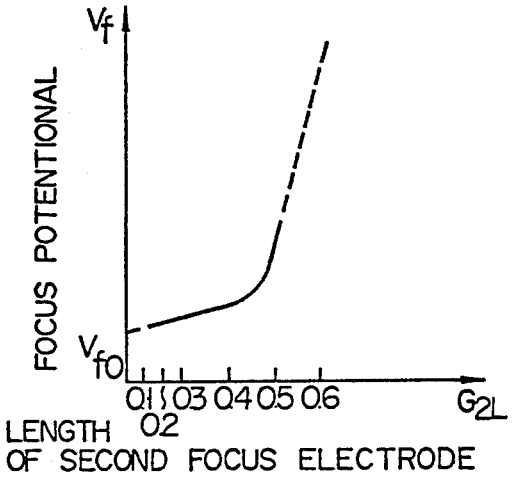
FIG. 6 graphically shows the relationship between the focusing voltage $V_f$ supplied to the first and third focusing electrodes of FIG. 4 and the length of the second focusing electrode.

The reduction of the divergent angle of an electron beam to the above-mentioned low level is attained by the following process. Now let it be assumed that with a cathode ray tube loaded with an electron gun comprising a bipotential type main lens system as shown in FIG. 1(*a*), the length of the first focusing electrode is so determined as to cause said electrode tube impressed with focusing voltage of $V_{fo}$. In a case of the present invention, referring to the FIG. 5, the length of the first focusing electrode $G_{1L}$ of the main lens system normalized by the diameter of the main lens system is fixed at 1.27 and a distance $g_1$ between the first and second focusing electrodes 24 and 25 is set at 0.027, and a distance $g_2$ between the second and third focusing electrodes 25, and 26 is chosen to be similarly 0.027, let it be assumed that the length ($G_{1L}+G_{2L}+G_{3L}+g_1+g_2$ shown in FIG. 5) of the main lens system of this invention adapted for use with an electron gun is made equal to the length of the first focusing electrode of the aforesaid prior art bipotential type mains lens system. When the first, second and third focusing electrodes 24, 25 and 26 of the main lens system of this invention are impressed with focusing voltage $V_{fo}$, the main lens system of the invention becomes exactly equivalent to the aforesaid bipotential type main lens system (assuming $G_{1L}, G_{3L} >> g_1, g_2$).

Where the length of the second focusing electrode 25 is slightly changed with the interelectrode distances $g_1$, $g_2$ fixed, then the focusing voltage $V_f$ impressed on the first and third focusing electrodes 24 and 26 sharply rises, as shown in FIG. 6, at a certain point and a nonfocusing state is eventually brought about.

With the main lens system of the present invention, therefore, the axial length of the second focusing electrode 25 and the interelectrode distances $g_1$, $g_2$ are so chosen as to enable the focusing electrodes of said lens system to be applied with high focusing voltages, in the range of +0.5 to 2.5 KV, than that applied to the prior art bipotential type main lens system having the same dimensions as that of the present invention. The second focusing electrode 25 is preferably set near to the cathode 21 a certain extent. If, however, it is disposed very close to a fluorescent screen, then the action of the second focusing electrode 25 as an originally intended auxiliary focusing electrode becomes unnecessarily strong, eventually causing the main lens system of this invention to lose such characteristic of low electron optical magnification as is realized by the prior art bipotential type main lens system. With all the above-mentioned factors taken into account, the lengths $G_{1L}$, $G_{2L}$, $G_{3L}$ of the first, second and third focusing electrodes should satisfy the relationship of $G_{3L} \geqq G_{1L} > G_{2L}$.

The main lens system of this invention for use with an electron gun which is arranged as described above has the following advantages.

(1) Since the scattering angle of an electron beam is easily reduced, blurring or haze taking place in the central portion of a picture caused by spherical aberration is prominently decreased, minimizing spot distortion resulting from errors in assembling an electron gun. The reason is that spherical aberration is proportional to the cube of the scattering angle of an electron beam, and the spot distortion decreases by the same extent as that to which the spherical aberration is reduced.

(2) Reduction of spherical aberration on a picture leads to a fall in a spot distortion in the peripheral portion of a picture in the case of a self-convergence type color television receiving set in which a deflection aberration noticeably appears as is usually the case, thereby improving the uniformity of focus (because the uniformity of focus and the spot distortion are proportional to the focusing angle of an electron beam).

(3) As broadly classified, the main lens system of this invention belongs to the bipotential type. However, the present main lens system drives back the imaginary object of a foreground subject more remotely than in the prior art, thereby decreasing the degree of electronic optical magnification.

(4) With the prior art bipotential type main lens system, a distance between the first and second grid electrodes and a distance between the second grid and first focusing electrodes are broadened in an attempt to elevate the uniformity of focus, but undesirably resulting in a decline in the resolution of the central portion of a picture. In contrast, the main lens system of the present invention is free from such drawback accompanying the above-mentioned design, effectively increasing the uniformity of focus. Further, with the prior art main lens system of the present invention, when the aforementioned design is employed, a distance between the cathode and first grid electrode is unavoidably broadened for obtaining a desired blanking voltage, thereby increasing the likelihood of a breakdown between the cathode and the first grid electrode due to the presence of floating particles in the cathode ray tube. The cathode ray tube of the present invention involves no such problem of breakdown because it is not necessary to narrow the distance between the cathode and first grid electrode.

(5) The focusing electrodes of the main lens system of this invention are made shorter than these of the tripotential type main lens system, thereby reducing spot distortion which might otherwise be caused by an unnecessary magnetic field such as a purity magnetic field.

There will now be described by reference to FIG. 7 the construction of a main lens system according to a second embodiment of this invention which is used with a cathode ray tube electron gun.

As in the first embodiment, the cathode ray tube electron gun comprises a triode-electrode section formed of a cathode 31 or electron beam-generating electrode, first electrode 32 and third electrode 33; and a main lens system consisting of first, second, third and fourth focusing electrodes 34, 38, 39 and 43. The first focusing electrode 34 comprises a shallow cup-shaped electrode element 35, similarly shaped electrode element 36 and a plate electrode element 37 spatially inserted therebetween. The second focusing electrode 38*a* is formed of two parallel spatially arranged plate electrode elements 38*b*. The third focusing electrode 39 is composed of two mutually facing shallow cup-shaped electrode elements 40, 42 and two parallel spatially arranged plate electrode elements 41 inserted therebetween. The fourth focusing electrode 43 is built of two mutually facing shallow cup-shaped electrode elements 44, 45. The electrode elements denoted by reference numerals, for example, 40, 41, 42 which are included in the main lens system of FIG. 7 arranged as described above and impressed with the same potential are jointly connected by a single conductor 46 as shown FIG. 8. The conductor 46 is connected at one end to a pin 48 penetrating a stem 47. The first to the fourth focusing electrodes 34, 38, 39, 43 are supported by spatially arranged support rods 49. The shallow cup-shaped electrode elements and plate electrode elements constituting the first to the fourth focusing electrodes are provided with three linearly aligned circular openings 50 each having a diameter l.

There will now be described by reference to FIG. 9 the construction of a main lens system according to a third embodiment of this invention, which is used with a cathode ray tube electron gun.

Figure 7:
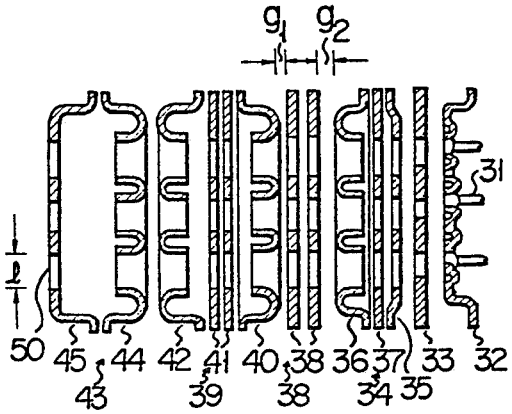
FIG. 7 is a sectional view of a main lens system according to another embodiment of the present invention which is used with a cathode ray tube electron gun.
Figure 8:
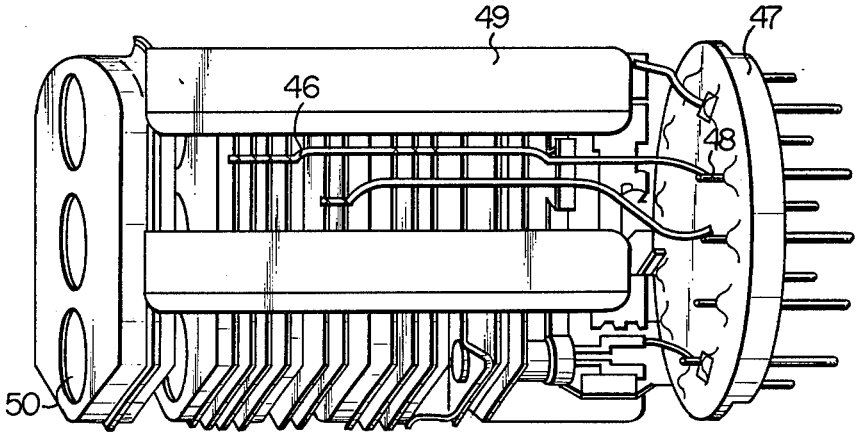
FIG. 8 is an oblique view of an electron gun comprising the main lens system of FIG. 7.
Figure 9:
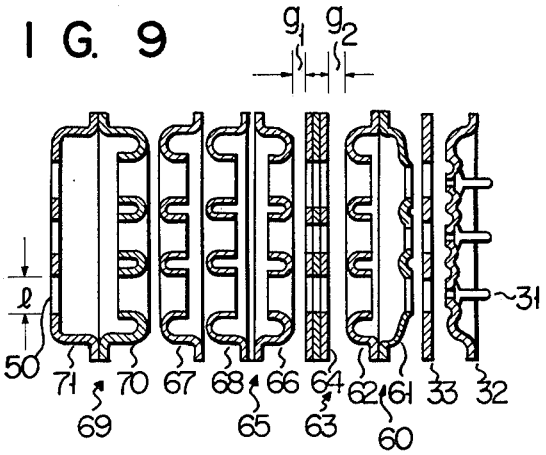
FIG. 9 is a sectional view of a main lens system according to still another embodiment of the present invention which is used with a cathode ray tube electron gun.

As in the preceding second embodiment of FIG. 7, the electron gun of the third embodiment of FIG. 9 comprises a 3-electrode section formed of a cathode 31 or electron beam-generating electrode, first electrode 32, and second electrode 33; and a main lens system composed of first to fourth focusing electrodes 60, 63, 65, 69. The first focusing electrode 60 is composed of mutually facing shallow cup-shaped electrode elements 61, 62. The second focusing electrode 63 is built of three laminated plate electrode elements 64. The third focusing electrode 65 is formed of two spatially arranged shallow cup-shaped electrode elements 66, 68 and a shallow cup-shaped electrode element 67 disposed in contact with one (for example 68) of said spatially arranged shallow cup-shaped electrode elements 66, 68. The fourth focusing electrode 69 consists of mutually facing shallow cup-shaped electrode elements 70, 71. The shallow cup-shaped electrode elements and plate electrode elements constituting the first to the fourth focusing electrodes 60, 63, 65, 69 are each provided with three linearly aligned circular openings 50. Those of the electrode elements which are impressed with the same potential are jointly connected by a single conductor 46 as in the second embodiment. The conductor 46 is connected at one end to a pin 48 penetrating a stem 47. The focusing electrodes 60, 63, 65, 69 are supported by one or two pairs of spatially set insulation support rods 49.

The plate electrode elements and shallow cup-shaped electrode elements used in the second and third embodiments can be fabricated with higher precision, are more effectively saved from thermal deformation with time and can be assembled with greater case, then in the prior art main lens system.

Where, with the second and third embodiment, too, the ratio which the length $G_{2L}$ of the second focusing electrode bears to the diameter l of the main lens system, and the ratios which the distance $g_1$ between said second focusing electrode and first focusing electrode and the distance $g_2$ between said second focusing electrode and third focusing electrode bear to the diameter l of the main lens system are all chosen to have prescribed values as described in connection with the first embodiment by reference to FIGS. 3 to 6, then the main lens system of this invention can have such property as satisfies the relationship shown in FIG. 6. Electron beams running along both sides of the central electron beam are sometimes focused by the main lens system in a different way from that in which the central electron beam is focused, according to the manner in which said two side electron beams are deflected. In such case, it is advised to change the shape or diameter of the openings drilled in the respective electrode elements through which the electron beams pass.

In the first, second and third embodiments, the second focusing electrode 25, 63 is chosen to have the same potential as the second electrode 23, 33 in of the triode-electrode section in a region inside or outside of the cathode ray tube. However, this arrangement is not always necessary. In other words, the second focusing electrode 25, 38, 63 may be applied with a potential the same as that which is applied to, for example, the first electrode 22, 32 of the triode-electrode section or the cathode 21, 31. Further, the second focusing electrode 25, 38, 63 may be applied with a potential several kilovolts higher than that which is applied on the third focusing electrode 26, 39, 65 or fourth focusing electrode 27, 43, 69. The first third and fourth focusing electrodes 24, 26, 27 of the main lens system of the first embodiment of this invention may be applied with voltage lower than that which is applied to the second focusing electrode 25.

Further, it is possible to build a main lens system of three focusing electrodes or four focusing electrodes and applies a desired level of voltage on a main lens system thus formed, thereby providing an electron gun composed of a uni- or tri-potential type main lens system as viewed collectively. The main lens system of this invention for use with a cathode ray tube electron gun is decidedly different from the prior art bi-, uni- and tri-potential types, and has a very great industrial use due to the previously described advantages.

We claim:

1. A cathode ray tube system comprising:

an electron beam-generating source including a cathode, first grid electrode and second grid electrode; and main lens means for substantially focusing electron beams emitted from said electron-beam generating source including first, second, third and fourth focusing electrodes arranged coaxially and in the order mentioned as counted from the second grid electrode of said electron beam-generating source and for creating an axial potential distribution having a function monotonically decreasing from a relatively intermediate potential level to a relatively low potential level from the first to the second focusing electrodes, and monotonically increasing from the relatively low potential to a relatively high potential level from the second focusing electrode to the fourth focusing electrode through the third electrode, and the second derivative of said function having two positive maximum values proximate the second and third focusing electrodes and three negative maximum values proximate the first, third and fourth focusing electrodes thereby forming a double lens construction.

2. The cathode ray tube system according to claim 1, or 8 wherein the axial length $G_{2L}$ of the second focusing electrode has the relationship of $G_{3L} \geqq G_{1L} > G_{2L}$ with the axial lengths $G_{1L}$, $G_{3L}$ of the first and third focusing electrodes.

3. The cathode ray tube system according to claim 2, wherein the axial length $G_{2L}$ of the second focusing electrode is longer than a distance $g_1$ between the first and second focusing electrodes and a distance $g_2$ between the second and third focusing electrodes.

4. The cathode ray tube system according to claim 3, wherein the axial length $G_{2L}$ of the second focusing electrode bears the ratio of 0.2 to 0.5 to the diameter of the main lens means.

5. The cathode ray tube system according to claim 1, wherein the first, second and third focusing electrodes locally constitute a unipotential type focusing lens, and the second focusing electrode is applied with a lower level of voltage than that which is applied to the first focusing electrode.

6. The cathode ray tube system according to claim 5, wherein the second focusing electrode has the same potential as the second grid electrode of said electron beam-generating source.

7. The cathode ray tube system according to claim 5, wherein the first and third focusing electrodes have a potential of about 4 to 10 KV, and the fourth focusing electrode has a potential of about 20 to 30 KV.

8. A cathode ray tube system comprising:

an electron beam-generating source including a cathode, first grid electrode and second grid electrode; and a main lens system for substantially focusing electron beams emitted from said electron beam-generating source including first, second, third and fourth focusing electrodes arranged coaxially and in the order mentioned as counted from the second grid electrode of said electron beam-generating source, the axial potential distribution of said main lens system having a function monotonically decreasing from a relatively intermediate potential level to a relatively low potential level from the first to the second focusing electrodes, and monotonically increasing from the relatively low potential to a relatively high potential level from the second focusing electrode to the fourth focusing electrode through the third electrode, and the second derivative of said function having two positive maximum values proximate the second and third focusing electrodes and three negative maximum values proximate the first, third and fourth focusing electrodes thereby forming a double lens construction; and means for applying said potential function.

* * * * *

US004368405B1

REEXAMINATION CERTIFICATE (2698th)

United States Patent [19] [11] B1 4,368,405

Takenaka et al. [45] Certificate Issued Oct. 24, 1995

[54] ELECTRON GUN FOR A CATHODE RAY TUBE

[75] Inventors: Shigeo Takenaka, Fukaya; Eizaburo Hamano, Kumagaya; Shinpei Koshigoe, Fukaya, all of Japan

[73] Assignee: Tokyo Shibaura Denki Kabushiki Kaisha, Kawasaki, Japan

Reexamination Request:
No. 90/003,759, Mar. 22, 1995

Reexamination Certificate for:

| | |
|---|---|
| Patent No.: | **4,368,405** |
| Issued: | **Jan. 11, 1983** |
| Appl. No.: | **191,016** |
| Filed: | **Sep. 26, 1980** |

Related U.S. Application Data

[63] Continuation of Ser. No. 961,855, Nov. 17, 1978, abandoned.

[30] Foreign Application Priority Data

| | | | |
|---|---|---|---|
| Nov. 22, 1977 | [JP] | Japan | 52-139480 |
| Dec. 22, 1977 | [JP] | Japan | 52-165601 |

[51] Int. Cl.[6] ..... H01J 29/46; H01J 29/56

[52] U.S. Cl. ..... 315/16; 313/449

[58] Field of Search ..... 315/16, 382, 382.1; 313/449

[56] References Cited

U.S. PATENT DOCUMENTS 3,852,637 12/1974 Yamazaki et al. .

FOREIGN PATENT DOCUMENTS

| | | |
|---|---|---|
| 909123 | 4/1954 | Germany . |
| 480672 | 6/1936 | United Kingdom . |
| 825898 | 8/1958 | United Kingdom . |

OTHER PUBLICATIONS

Electron Optics In Television, Oxford 1961, pp. 148–150.

*Primary Examiner*—Theodore M. Blum

[57] ABSTRACT

A cathode ray tube electron gun having an electron beam-generating source and a main lens system for focusing electron beams emitted from said electron beam-generating source, wherein the main lens system comprises at least first, second, third and fourth focusing electrodes arranged coaxially and in the order mentioned an counted from said electron beam-generating source; the first and third focusing electrodes are inpressed with substantially the same potential; and the fourth focusing electrode is supplied with a precribed potential higher than those which are applied to said first and third focusing electrodes.

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–8 is confirmed.

* * * * *